US008926769B2

(12) United States Patent
Norling

(10) Patent No.: US 8,926,769 B2
(45) Date of Patent: Jan. 6, 2015

(54) NI—CR—FE ALLOY FOR HIGH-TEMPERATURE USE

(75) Inventor: Rikard Norling, Vasteras (SE)

(73) Assignee: Sandvik Intellectual Property AB, Sandviken (SE)

( * ) Notice: Subject to any disclaimer, the term of this patent is extended or adjusted under 35 U.S.C. 154(b) by 0 days.

(21) Appl. No.: 13/157,550

(22) Filed: Jun. 10, 2011

(65) Prior Publication Data

US 2011/0259875 A1 Oct. 27, 2011

Related U.S. Application Data

(62) Division of application No. 11/994,372, filed as application No. PCT/SE2006/050201 on Jun. 16, 2006, now abandoned.

(30) Foreign Application Priority Data

Jul. 1, 2005 (SE) ..... 0501536

(51) Int. Cl.
*C22C 19/05* (2006.01)
*H05B 3/12* (2006.01)

(52) U.S. Cl.
CPC ..... *H05B 3/12* (2013.01); *C22C 19/058* (2013.01)
USPC ..... 148/427; 420/452; 219/553

(58) Field of Classification Search
USPC ..... 420/452; 148/427; 219/553
See application file for complete search history.

(56) References Cited

U.S. PATENT DOCUMENTS

| | | | | | |
|---|---|---|---|---|---|
| 2,555,609 | A | * | 6/1951 | Saffell | 392/351 |
| 2,816,200 | A | * | 12/1957 | Mudge | 174/102 R |
| 2,850,383 | A | * | 9/1958 | Starr et al. | 420/445 |
| 2,858,208 | A | | 10/1958 | Spooner et al. | |
| 3,865,581 | A | | 2/1975 | Sekino et al. | |
| 4,400,211 | A | | 8/1983 | Kudo | |
| 4,994,118 | A | | 2/1991 | Pircher | |

(Continued)

FOREIGN PATENT DOCUMENTS

| | | | |
|---|---|---|---|
| EP | 0251295 | A2 | 1/1988 |
| EP | 0295030 | A2 | 12/1988 |

(Continued)

OTHER PUBLICATIONS

ASM International, Materials Park, Ohio, Properties and Selection: Nonferrous Alloys and Special Purpose Materials: "Rare Earth Metals", Oct. 1990, vol. 2, pp. 720-732.

(Continued)

*Primary Examiner* — Jessee Roe
(74) *Attorney, Agent, or Firm* — Morgan, Lewis & Bockius LLP

(57) ABSTRACT

The present application relates to an alloy for use at high temperature. The invention is characterized in that the alloy consists principally of Ni, Cr and Fe and in that the alloy has a principal composition such that the levels of the elements Fe, Si, C, Nb and Mo lie within the following intervals, given in percentage by weight: Fe 5-13 Si 1-3 C <0.1 Nb <0.2 Mo <1.0 and in that Ni comprises the balance, while its level does not exceed 69% and in that the level of Cr is greater than Cr=15% and in that it is less than the lower of the two values Cr=5*Si−2.5*Fe+42.5 and Cr=25.

24 Claims, 3 Drawing Sheets

(56) References Cited

U.S. PATENT DOCUMENTS

Figure 1:
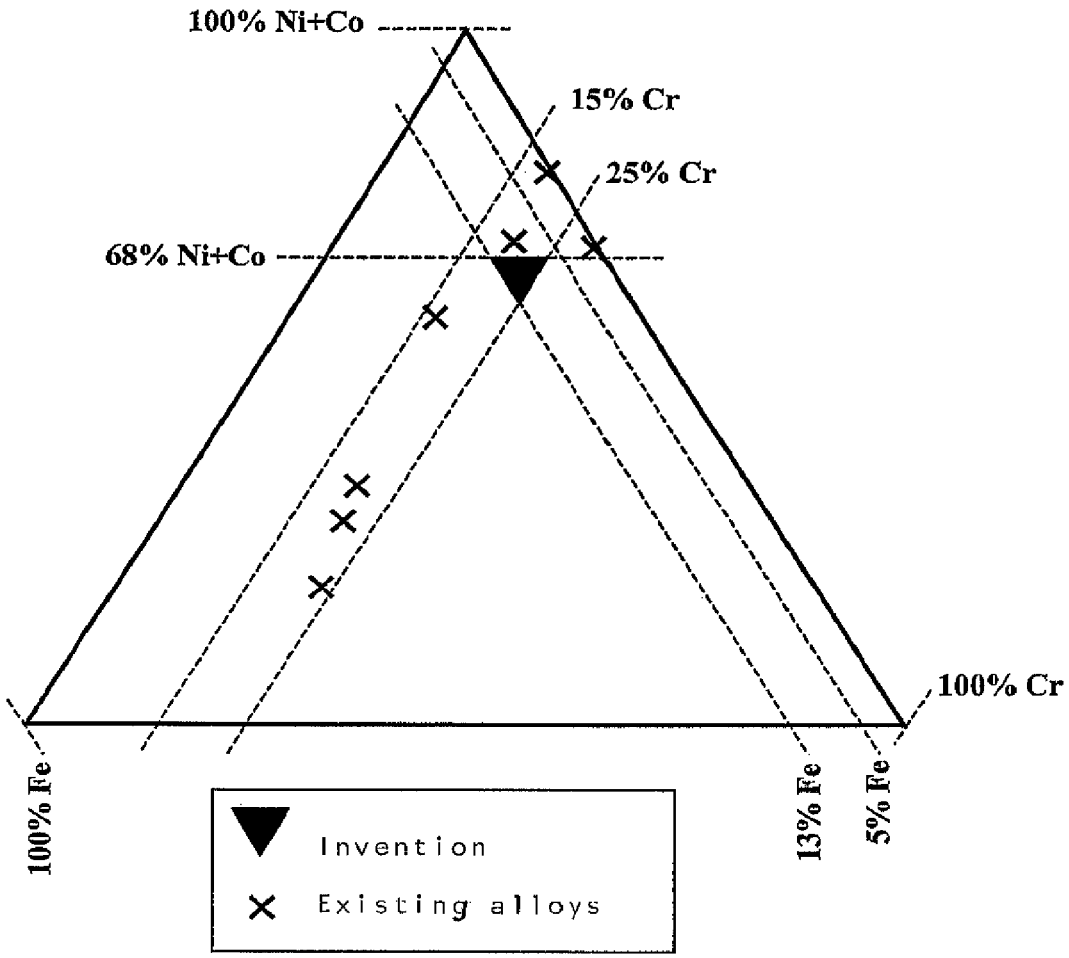

| | | | |
|---|---|---|---|
| 4,997,623 | A | 3/1991 | Brill |
| 5,603,891 | A | 2/1997 | Brill |
| 6,623,869 | B1 | 9/2003 | Nishiyama |

FOREIGN PATENT DOCUMENTS

| | | | |
|---|---|---|---|
| EP | 0 386 730 | A1 | 9/1990 |
| EP | 0 531 775 | A1 | 3/1993 |
| EP | 0549286 | A1 | 6/1993 |
| EP | 1065290 | A1 | 1/2001 |
| EP | 1325965 | A1 | 7/2003 |
| FR | 926323 | A | 9/1947 |
| FR | 2286885 | A1 | 4/1976 |
| GB | 1151178 | A | 5/1969 |
| GB | 1210607 | A | 10/1970 |
| GB | 2167440 | A | 5/1986 |
| JP | 61000551 | A | 1/1986 |
| JP | 03100134 | | 4/1991 |
| JP | 07-242971 | | 9/1995 |
| JP | 7-242971 | | 9/1995 |
| JP | 2002-249838 | | 9/2002 |
| WO | 2005/031018 | | 4/2005 |

OTHER PUBLICATIONS

Office Action (with English translation) for Japanese Application No. 2008-519232, dated Dec. 18, 2012.

Office Action (with English translation) for Korean Application No. 10-2008-7001617, dated Mar. 7, 2013.

Office Action for Swedish Patent Application No. 0501536-7, dated Jan. 25, 2006.

International Search Report for Application No. PCT/SE2006/050201, dated Oct. 17, 2006.

Written Opinion of the International Searching Authority for Application No. PCT/SE2006/050201, dated Oct. 17, 2006.

Office Action for Swedish Patent Application No. 0501536-7, dated Jan. 3, 2008.

Notification of the First Office Action for Chinese Application No. 200680023632.3, dated Mar. 8, 2009.

Rejection Decision for Chinese Application No. 200680023632.3, dated Dec. 20, 2010.

Office Action for Swedish Patent Application No. 0501536-7, dated Jun. 27, 2011.

Notification of the Second Office Action for Chinese Application No. 200680023632.3, dated Aug. 29, 2011.

Official Action and English Translation for Japanese Application No. 2008-519232, dated Aug. 31, 2012.

Official Action and English Translation for Japanese Application No. 2008-519232, dated Dec. 18, 2012.

Extended European Search Report, dated Jul. 19, 2010, from corresponding EP application No. EP 06 74 8041.

Translation of Japanese Office Action, dated Jul. 1, 2011, from corresponding JP application No. 2008-519232.

* cited by examiner

NI—CR—FE ALLOY FOR HIGH-TEMPERATURE USE

BACKGROUND OF THE INVENTION

The present invention relates to a Ni—Cr—Fe alloy for use at high temperatures.

DESCRIPTION OF THE RELATED ART

Austenitic alloys based on the Ni—Cr and the Ni—Cr—Fe system with chromium contents of up to 30% by weight and silicon contents up to 3% by weight have been used for many years for high-temperature uses, up to operating temperatures of 1,100° C. These alloys often contain also additions of small quantities of rare earth metals. A number of such alloys with different nickel levels, intended to be used as electrical resistance materials for heating in, among other applications, industrial furnaces and household appliances have been defined as standards in ASTM B 344-01 and in DIN 17 470 (together with DIN 17 742). These standards are not fully in agreement with each other, as can be seen in Table 1. Table 1 also specifies the nominal composition of a non-standard alloy, as specified by U.S. Pat. No. 2,858,208. This alloy is, as far as is known, no longer commercially available, but it has received a certain amount of previous use for the same applications.

TABLE 1

Chemical compositions in percentage by weight of Ni—Cr—(Fe) resistive materials as specified by the DIN and ASTM standards, and that of an alloy as specified by U.S. Pat. No. 2,858,208.

| | Ni | Cr | Fe | Si | Mn | C | Other |
|---|---|---|---|---|---|---|---|
| DIN 17 470 | | | | | | | |
| NiCr 80 20* | >75** | 19-21 | <1.0 | 0.5-2.0 | <1.0 | <0.15 | Al < 0.3; Cu < 0.5 |
| NiCr 70 30* | >60** | 29-32 | <5.0 | 0.5-2.0 | <1.0 | <0.10 | Al < 0.3; Cu < 0.5 |
| NiCr 60 15* | >59** | 14-19 | 19-25 | 0.5-2.0 | <2.0 | <0.15 | Al < 0.3; Cu < 0.5 |
| NiCr 30 20 | 28-31 | 20-22 | bal. | 2.0-3.0 | <1.5 | <0.2 | |
| CrNi 25 20 | 19-22 | 22-25 | bal. | 1.5-2.5 | <2.0 | <0.2 | |
| ASTM B344 | | | | | | | |
| 80Ni—20Cr | bal.** | 19-21 | <1.0 | 0.75-1.75 | <1.0 | <0.15 | |
| 60Ni—16Cr | >57** | 14-18 | bal. | 0.75-1.75 | <1.0 | <0.15 | |
| 35Ni—20Cr | 34-37** | 18-21 | bal. | 1.0-3.0 | <1.0 | <0.15 | |
| U.S. Pat. No. 2,858,208 | 67.75 | 20.0 | 8.3 | 2.0 | 0.5 | <0.1 | Co = 1.0; Nb = 0.25 |

*Also DIN 17 742
**Includes up to 1% Co.

It is generally the case that the maximum operating temperature and the life-time increase with increasing Ni content for Ni—Cr—(Fe) alloys, but a number of other alloy elements have a major influence on these properties. A protective oxide layer forms on these alloys, principally consisting of $Cr_2O_3$ and in a number of cases also to a certain extent of $SiO_2$, if Si is added to the alloy. Small additions of certain substances such as rare earth metals have been used in order to further improve the properties of the oxide layer, and a number of patents recommend this in order to obtain a material with a high oxidation stability. Examples of such patents are EP 0 531 775 and EP 0 386 730.

It is a requirement that electrical resistive materials have, in addition to a high oxidation stability, a relatively high electrical resistivity such that it is possible to obtain the desired power development within an electrical heating element with given limitations in dimensions and weight. It is generally the case that if an electrical heat element with a certain nominal power is manufactured with the same cross-sectional area as the conductor, an alloy with a higher resistivity gives rise to a shorter conductor and thus a saving in weight, which leads directly to a saving in costs.

The change in resistivity at elevated temperature, $C_t$, is given by the ratio between the electrical resistance at the working temperature and that at room temperature for an electrical resistive material. This parameter is an important factor in obtaining an even distribution of temperature along the electrical resistive element, particularly when the total service time increases. The lower the value of $C_t$, the more even will be the distribution of temperature, and this will normally result in a longer life-time for the element, since the risk of local overheating is reduced. It is generally the case that $C_t$ decreases with increasing Ni content, but the levels of Cr, Fe and Si are also significant. The $C_t$-value for resistive material with a Ni content of over 40% depends also on the rate at which the alloy cooled following the most recent heating to red-hot.

Table 2 gives typical values for the resistivity at room temperature and of $C_t$ at 1,000° C. for alloys with compositions as specified by ASTM B 344-01 and by DIN 17 470, together with an alloy as specified by U.S. Pat. No. 2,858,208. All of the alloys tested were tested in the form of wire that had been heated to red-hot and then allowed to cool freely in air after the annealing. The values in Table 2 are based on comparative measurements taken on one and the same measurement occasion by the applicant, and are not taken directly from the published standards. These standards give recommended values only, or they prescribe intervals that are so large that the values given cannot be directly compared.

The $C_t$-value in this case has been determined as specified by ASTM B70-90 with one modification: the resistivity of the test material before the test was used as reference value for calculating the $C_t$-value, and not the resistivity after the test had been carried out.

TABLE 2

Typical values of the resistivity (ohm * $mm^2$/m) at room temperature, and of $C_t$ at 1000° C. for NiCr(Fe) resistive materials.

| | Resistivity | $C_t$ |
|---|---|---|
| NiCr 80 20/80Ni—20Cr | 1.09 | 1.05 |
| NiCr 70 30 | 1.18 | 1.05 |
| NiCr 60 15/60Ni—16Cr | 1.11 | 1.11 |
| 35Ni—20Cr | 1.04 | 1.23 |
| NiCr 30 20 | 1.03 | 1.25 |
| CrNi 25 20 | 0.95 | 1.32 |
| U.S. Pat. No. 2,858,208 | 1.16 | 1.06 |

The $C_t$-value is particularly significant for the life-time of the cover at high operating temperatures of tube elements with metal cover, which consist of an electrical heating coil embedded in an electrically insulating MgO powder placed inside of the cover. This is a result of the fact that the insulating properties of MgO depend very heavily on the temperature, and thus zones of elevated temperature have a tendency to cause leakage currents or even short-circuits between the heating coil and the metal cover.

A typical application for tube elements with a metal cover with a high operating temperature of the cover is that of grill element in a domestic oven. It is well-known that elements with heating coils made from alloys of the type NiCr 80 20 achieve a more even distribution of temperature along the element and a longer life-time than equivalent elements with the heating coil made of alloys of the type NiCr 60 15. The more even distribution of temperature of the first-named type of element also leads to a more even distribution of heat in the domestic oven, something that is normally desired.

Alloys based on the Fe—Cr—Al system are also used as tube elements in general, and in particular as water-heating tube elements. These alloys, however, are not suitable for elements that operate under such conditions of load that the cover glows red, since it is well-known that the presence of Al in the alloys in these cases leads over time to poor insulating ability of the MgO powder.

Addition of Nb, Mo and W is carried out for some nickel-based alloys with the aim of improving the mechanical properties at high temperatures. The high cost of these alloy elements, however, means that this procedure is not desirable for application in which the cost is a significant factor. In particular, the addition of Nb also leads to a lower hot workability of the alloy, which results in a reduction in the productivity during hot-rolling, and this introduces an increase in production costs.

A level of C that is higher than 0.1% by weight is found in certain nickel-based alloys for high-temperature use. These alloys are known as "cast alloys" and they are not suitable for working using normal methods such as rolling and extrusion, which are used, among other applications, to form electrical resistive material. The high content of carbon makes these alloys also unsuitable for use as electrical resistive material for heating due to, among other factors, their limited oxidation stability.

Alloys with a Cr content greater than 25% by weight generally have poor workability properties, which results in high production costs. This limits the use of such alloys, for example of the type NiCr 70 30, to applications in which the cost is less significant.

SUMMARY OF THE INVENTION

The present invention offers compositions of an alloy of Ni—Cr—Fe that combines a relatively low cost of production, if possible as low as that of NiCr 60 15, with the following properties: good oxidative stability, a relatively high electrical resistivity, and a small change in resistivity with increasing temperature such as, for example, that of NiCr 80 20. Important factors for achieving a low cost of production are the good hot workability of the compositions, and the low overall content of expensive alloy elements such as nickel and cobalt.

The present invention thus relates to an alloy for use at high temperature, characterised in that the alloy principally consists of Ni, Cr and Fe and in that the alloy has a principal composition such that the levels of the elements Cr, Fe, Si, C and Nb lie within the following intervals of percentage by weight:

Cr 15-25

Fe 5-13

Si 1-3

C <0.1

Nb <0.2 and in that the balance is made up by Ni, but not exceeding 69%.

In order to obtain a satisfactory $C_t$-value, the alloy according to the present invention should contain at least 57% Ni, preferably at least 60%.

According to one preferred embodiment, the alloy can furthermore contain Al, Ca, Cu, Hf, Mg, Mn, Mo, N, Ta, Ti, V, W, Y, Zr and rare earth metals up to a total of 7% and impurities up to a maximum of 1%. Co can replace Ni by up to 5%.

The invention will be described in more detail below, partially in association with embodiments of the invention shown on the attached drawings, where:

BRIEF DESCRIPTION OF THE DRAWING FIGURES

Figure 2:
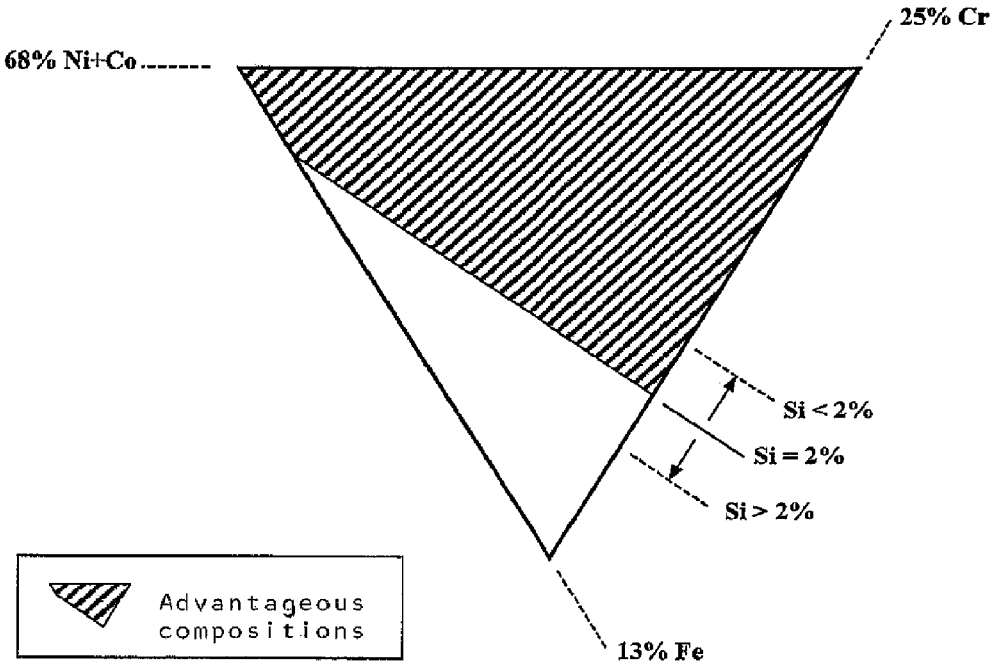
Figure 3:
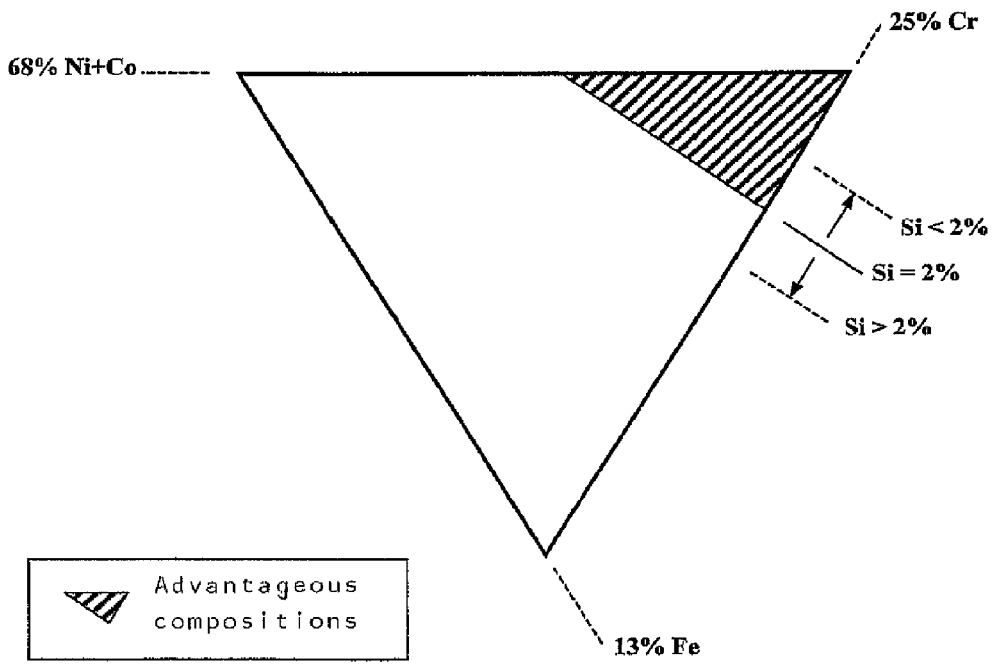

FIG. 1 shows a region of advantageous and particularly advantageous compositions of the alloy according to the invention in comparison with existing alloys, in the form of a phase diagram, FIG. 2 shows a region of advantageous and particularly advantageous compositions of the alloy according to the invention with a level of Si of 2%, in the form of a phase diagram, and FIG. 3 shows an alternative region of advantageous and particularly advantageous compositions of the alloy according to the invention with a level of Si of 2%, in the form of a phase diagram.

DETAILED DESCRIPTION OF THE INVENTION

According to one embodiment, an alloy according to the invention is characterised in that its $C_t$-value at 1,000° C. is 1.10 or lower. The $C_t$-value can be measured as specified by, for example, the standard ASTM B70-90.

Eight different compositions of the alloy according to the invention have been smelted at laboratory scale, hot-rolled and cold-drawn to wire following standard procedures. The chemical compositions of the alloys, their resistivities and their $C_t$-values at 1,000° C. are given in Table 3 and Table 4.

TABLE 3

Chemical compositions (percentage by weight) of test smelts. Ni is used as balance element.

| | Smelt no. | | | | | | | |
|---|---|---|---|---|---|---|---|---|
| | 1 | 2 | 3 | 4 | 5 | 6 | 7 | 8 |
| Cr | 24.0 | 23.6 | 15.9 | 16.1 | 23.8 | 23.6 | 16.4 | 16.4 |
| Fe | 12.8 | 13.1 | 13.0 | 13.1 | 5.0 | 5.3 | 5.2 | 4.9 |
| Si | 2.4 | 1.0 | 2.5 | 1.0 | 2.2 | 1.0 | 2.2 | 1.0 |

TABLE 3-continued

| Chemical compositions (percentage by weight) of test smelts. Ni is used as balance element. | | | | | | | | |
|---|---|---|---|---|---|---|---|---|
| | Smelt no. | | | | | | | |
| | 1 | 2 | 3 | 4 | 5 | 6 | 7 | 8 |
| Mn | 0.7 | 0.1 | 0.1 | 0.7 | 0.1 | 0.7 | 0.7 | 0.1 |
| C | 0.02 | 0.02 | 0.02 | 0.02 | 0.02 | 0.01 | 0.02 | 0.02 |
| P | 0.005 | 0.005 | 0.004 | 0.004 | 0.005 | 0.005 | 0.004 | 0.004 |
| S | 0.001 | 0.003 | 0.003 | 0.001 | 0.001 | 0.002 | 0.001 | 0.002 |
| Other elements | <0.5 | <0.5 | <0.5 | <0.5 | <0.5 | <0.5 | <0.5 | <0.5 |

TABLE 4

| Resistivity (ohm * $mm^2$/m) at room temperature and $C_t$ at 1,000° C. for test smelts. | | | | | | | | |
|---|---|---|---|---|---|---|---|---|
| | Smelt no. | | | | | | | |
| | 1 | 2 | 3 | 4 | 5 | 6 | 7 | 8 |
| Resistivity | 1.24 | 1.16 | 1.16 | 1.11 | 1.23 | 1.16 | 1.12 | 1.05 |
| $C_t$ | 1.086 | 1.097 | 1.074 | 1.088 | 1.054 | 1.064 | 1.059 | 1.077 |

Table 5 gives a qualitative evaluation of raw materials cost, hot workability, oxidative stability and tube element life-time of the test smelts. A qualitative evaluation of the resistivity and $C_t$-value of the alloys has also been included in order to facilitate comparison. The evaluation of raw materials cost is based on the level of Ni in the alloys and the evaluation of hot workability is based on the results of the hot-rolling. The oxidative stability has been evaluated by heating test wires with a constant power that is produced by an electric current that is led through them, whereby the test wires have been cyclically exposed with periods of two minutes on and two minutes off. The times taken for the wires to burn through have been recorded and mutually compared. The life-time of the tube elements has been evaluated by testing tube elements with a metal cover, which elements have been manufactured by conventional methods with a resistive wire from each test smelt. The testing has been carried out such that each tube element has been subject to cyclic loading with a constant electrical power in periods of 60 minutes on and 20 minutes off. The times taken for the tube elements to cease to function have been recorded and mutually compared.

TABLE 5

| Qualitative evaluation of properties of test smelts. | | | | | | | | |
|---|---|---|---|---|---|---|---|---|
| | Smelt no. | | | | | | | |
| | 1 | 2 | 3 | 4 | 5 | 6 | 7 | 8 |
| Raw materials cost | + | + | 0 | 0 | 0 | 0 | − | − |
| Hot workability | 0 | 0 | 0 | 0 | − | 0 | 0 | 0 |
| Oxidative stability | − | − | − | + | − | 0 | + | 0 |
| Tube element life-time | X | 0 | 0 | 0 | X | + | 0 | + |
| Resistivity | + | 0 | 0 | − | + | 0 | − | − |
| $C_t$ | − | − | 0 | − | + | + | + | 0 |

"+" specifies that the property has been assessed as being better than average,
"0" as average, and
"−" as poorer than average.
"X" specifies that a property has not been assessed.

The results show that there is a complex correlation between the levels of the base elements Ni, Cr, Fe and Si in order to obtain a combination of the properties desired: high resistivity, low $C_t$, high oxidative stability and long tube element life-time. It is only within a limited region of compositions that an optimal compromise can be found between these properties and good hot workability and low raw materials cost.

Analysis of the data obtained for the evaluated properties of the laboratory smelts has made it possible to determine that the interval for advantageous and particularly advantageous compositions for an alloy according to the invention. FIG. 1 shows an overview of the region in which advantageous and particularly advantageous compositions of the alloy according to the invention can be found. The compositions of existing NiCr(Fe) resistive alloys according to Table 1 have been marked for comparison. The drawing is only an illustration and it does not take into consideration small deviations that depend on the presence of other alloy elements than Ni, Co, Fe and Cr.

An alloy according to the invention contains at least 1% Si, preferably at least 1.5% Si. Addition of Si raises the oxidative resistance and the resistivity, and it lowers the $C_t$-value.

It is an advantage that an alloy according to the invention has a composition (given in percentages by weight) in which the level of Fe lies within the interval 5 to 13 and that of Si lies within the interval 1 to 3, and where the level of Cr is greater than Cr=15 and less than the lower of the two values Cr=5*Si−2.5*Fe+42.5 and Cr=25, and where Ni makes up the balance, without the level of Ni exceeding 68%.

It is also preferred that the alloy contains also up to 5% Co as replacement for Ni, and up to 2% Mn. The alloy can also contain in addition to this Al at a level of up to 0.4% and rare earth metals (lanthanides, i.e. elements from La to Lu), Y, Ca and Mg up to a total level of 0.3%. It can furthermore contain elements that form nitrides and carbides such as Ti, Zr, Hf, Nb, Ta, and V up to a total level of 0.4%, values of these substances that are too high, however, can lead to the alloy becoming difficult to manufacture. The level of C is lower than 0.1% and the level of N does not exceed 0.2%. The total level of Cu, Mo and W does not exceed 1%. Other substances that constitute impurities in the present alloy and that are derived from raw materials and the manufacturing process can be present in levels up to 1%.

An alloy with a preferred composition according to the description above is characterised in that its $C_t$-value at 1,000° C. is 1.08 or lower. FIG. 2 shows in detail the region of these compositions for a level of Si of 2%. The way in which the region is changed with an increasing or decreasing level of Si is indicated in the drawing.

It is particularly preferred that the alloy according to the invention has a composition (given in percentages by weight) in which the level of Fe lies within the interval 5 to 13 and that of Si lies within the interval 1 to 3, and where the level of Cr is greater than Cr=15 and less than the lower of the two values Cr=0.7*Si*(2*Si−1)−2.5*Fe+42.5 and Cr=25, and where Ni makes up the balance, without the level of Ni exceeding 68%.

It is also preferred that the alloy contain also up to 5% Co as replacement for Ni, and up to 2% Mn. The alloy can also contain in addition to this Al at a level of up to 0.4% and rare earth metals (lanthanides, i.e. elements from La to Lu), Y, Ca and Mg up to a total level of 0.3%. It can furthermore contain elements that form nitrides and carbides such as Ti, Zr, Hf, Nb, Ta, and V up to a total level of 0.4%. The level of C is lower than 0.1% and the level of N does not exceed 0.2%. The total level of Cu, Mo and W does not exceed 1%. Other substances that constitute impurities in the present alloy and that are derived from raw materials and the manufacturing process can be present in levels up to 1%.

An alloy with a preferred composition according to the description above is characterised in that its $C_t$-value at 1000° C. is 1.07 or lower. FIG. 3 shows in detail the region of these compositions for a level of Si of 2%. The way in which the region is changed with an increasing or decreasing level of Si is indicated in the drawing.

A specific example of an alloy according to the invention is given below. The alloy contains (levels are given in percentages by weight):

Cr 22.5
Fe 8.9
Si 2.5
Mn 0.7
C 0.01
N 0.03
Ce 0.01
Co <0.01
Nb <0.01
impurities up to 0.7%
Ni balance.

This composition has been smelted using an industrial method and at full scale, it has been hot-rolled and cold-drawn to wire as specified by standard procedures and it has thus obtained the following advantageous properties:

a hot workability that is as good as those of NiCr 80 20 and NiCr 60 15, an oxidative stability that is approximately 50% greater than that of any one of the alloys in Table 2, which have all been tested using the same method, a resistivity of 1.22 ohm*mm$^2$/m and a $C_t$-value of 1.067 at 1000° C.

The life time of the alloy according to the example when the element is an uninsulated freely radiating heating element in an industrial oven has been investigated. The furnace temperature was 900° C. and the element was fed with a constant power during periods of 90 seconds and no power during 30 seconds. The resulting life time was approximately the same as the life time of the alloy $N_iC_r$ 70 30, 25% lower than for $N_iC_r$ 80 20 and 65% lower than for $N_iC_r$ 60 15.

It is important in the present compositions that the level of Nb is low. This is illustrated by the following. A smelt was prepared using the same method of manufacture and with an identical composition as in the example above, except for the addition of 0.2 percent by weight of Nb.

The addition of Nb resulted in the oxidative life-time being shortened by over 40% and the hot workability becoming worse, to a level corresponding to that of NiCr 70 30. The resistivity and the $C_t$-value were unchanged.

The life time of the heating element was shortened with almost 50%.

A certain low level of Nb can, however, be accepted for certain applications even if certain properties are poorer, due to the fact that the manufacturing cost becomes lower than that of known material with corresponding properties.

The effect of an addition of Ta are expected to be the same as those of the addition of Nb in the present alloy. The level of Ta should, for this reason, also be limited up to a value of 0.2 percent by weight.

The invention claimed is:

1. An electrical heating arrangement comprising an electrically resistive material manufactured from an alloy comprising:

a Ni, Cr and Fe alloy having a composition as follows, given in percentage by weight:
Cr 22-24%,
Fe 8-10%,
Si >1.5-3%,
Mn 0.5-0.9%,
Al up to 0.4%,
C<0.1%,
N 0.01-0.05%,
Ce<0.03%,
Co<0.1%,
Nb<0.2%,
Mo<1.0%,
impurities up to 1%, and
Ni comprises a balance, wherein the alloy has a $C_t$-value at 1000° C. of 1.10 or lower.

2. The electrical heating arrangement according to claim 1, wherein Ni does not exceed 67%.

3. The electrical heating arrangement according to claim 1, wherein Ni does not exceed 66%.

4. The electrical heating arrangement according to claim 1, wherein the alloy contains Al, Ca, Cu, Hf, Mg, Mn, Mo, N, Nb, Ta, Ti, V, W, Y, Zr or rare earth metals up to a total metals level of 7%, and in that a level of impurities constitutes a maximum of 1%.

5. The electrical heating arrangement according to claim 1, wherein the $C_t$-value at 1000° C. is 1.08 or lower.

6. The electrical heating arrangement according to claim 1, wherein the alloy has the following composition, given in percentages by weight, Cr 22-24%;
Fe 8-10%;
Si 2.2-2.7%;
Mn 0.5-0.9%;
Al up to 0.4%,
C<0.03%;
N 0.01-0.05%;
Ce<0.03%;
Co<0.1%;
Nb<0.05%;
impurities up to 1%; and
Ni comprises the balance.

7. The electrical heating arrangement according to claim 1, wherein the alloy has the following composition, given in percentages by weight, Cr 22-23%;
Fe 8.5-9.5%;
Si 2.3-2.6%;
Mn 0.6-0.7%;
Al up to 0.4%,
C<0.02%;
N 0.01-0.03%;
Ce 0.005-0.015%;
Co<0.01%;
Nb<0.01%;
impurities up to 0.7%; and
Ni comprises the balance.

8. The electrical heating arrangement according to claim 1, wherein the alloy has a room temperature resistivity of 1.05 to 1.24 ohm*mm$^2$/m.

9. The electrical heating arrangement according to claim 1, wherein the $C_t$-value at 1000° C. is greater than or equal to 1.05 and less than or equal to 1.08.

10. An electrical heating arrangement comprising an electrically resistive material manufactured from an alloy comprising:

a Ni, Cr and Fe alloy having a composition as follows, given in percentage by weight:

Cr 22-24%,
Fe 8-10%,
Si>1.5-3%,
Mn 0.5-0.9%,
Al up to 0.4%,
C<0.1%,
N 0.01-0.05%,
Ce<0.03%,
Co<5%,
Nb<0.2%,
Mo<1.0%,
impurities up to 1%, and
Ni comprises a balance of at least 57%, wherein the alloy has a $C_t$-value at 1000° C. of 1.10 or lower, and wherein up to 5% of the Co is present as a replacement for an equal amount of Ni.

11. The electrical heating arrangement according to claim 10, wherein Co is present in the composition up to 0.9% and up to 0.8% of the Co is present as a replacement for Ni.

12. The electrical heating arrangement according to claim 10, wherein Co is present in the composition up to 0.6% and up to 0.5% of the Co is present as a replacement for Ni.

13. The electrical heating arrangement according to claim 10, wherein Co is present in the composition up to 0.2% and up to 0.1% of the Co is present as a replacement for Ni.

14. The electrical heating arrangement according to claim 10, wherein Ni does not exceed 66%.

15. An electrical heating arrangement comprising an electrically resistive material manufactured from an alloy comprising:

Ni, Cr and Fe, and the alloy has a principal composition such that levels of elements Fe, Si, C, Nb and Mo lie within intervals as follows, given in percentage by weight: Fe 5-13%, Si>1.5-3%, C<0.1%, Nb<0.2% and Mo<1.0%, and Al is present up to 0.4%, Ni comprises a balance but does not exceed 69%, and a level of Cr is greater than Cr=15% and is less than a lower of two values Cr=0.7*Si*(2*Si−1)−2.5*Fe+42.5 and Cr=25%, and the alloy has a $C_t$-value at 1000° C. of 1.08 or lower.

16. The electrical heating arrangement according to claim 15, wherein the $C_t$-value at 1000° C. is 1.07 or lower.

17. The electrical heating arrangement according to claim 15, wherein the alloy has a room temperature resistivity of 1.05 to 1.16 ohm*mm$^2$/m.

18. The electrical heating arrangement according to claim 15, wherein the $C_t$-value at 1000° C. is greater than or equal to 1.05 and less than or equal to 1.08.

19. The electrical heating arrangement according to claim 15, wherein Ni does not exceed 67%.

20. An electrical heating arrangement comprising an electrically resistive material manufactured from an alloy comprising:

Ni, Cr and Fe and the alloy has a principal composition such levels of elements Fe, Si, C, Nb and Mo lie within intervals as follows, given in percentage by weight: Fe 5-13%, Si>1.5-3%, C<0.1%, Nb<0.2% and Mo<1.0%, and Al is present up to 0.4%, Ni comprises a balance but does not exceed 69%, and a level of Cr is greater than Cr=15% and is less than a lower of two values Cr=5*Si−2.5*Fe+42.5and Cr=25%, and the alloy has a $C_t$-value at 1000° C. of 1.08 or lower.

21. The alloy according to claim 20, wherein Ni does not exceed 68%.

22. The alloy according to claim 20, wherein Ni does not exceed 67%.

23. The electrical heating arrangement according to claim 20, wherein the alloy has a room temperature resistivity of 1.05 to 1.16 ohm*mm$^2$/m.

24. The electrical heating arrangement according to claim 20, wherein the $C_t$-value at 1000° C. is greater than or equal to 1.05 and less than or equal to 1.08.

* * * * *